US007398024B2

(12) United States Patent
Ishihara

(10) Patent No.: US 7,398,024 B2
(45) Date of Patent: Jul. 8, 2008

(54) IMAGE FORMING APPARATUS

(75) Inventor: Chikara Ishihara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 419 days.

(21) Appl. No.: 11/274,473

(22) Filed: Nov. 16, 2005

(65) Prior Publication Data

US 2006/0291875 A1 Dec. 28, 2006

(30) Foreign Application Priority Data

Nov. 30, 2004 (JP) ..... 2004-345223

(51) Int. Cl.
*G03G 15/00* (2006.01)
*G03G 21/00* (2006.01)

(52) U.S. Cl. ..... 399/21; 399/75; 399/66

(58) Field of Classification Search ..... 399/407, 399/21

See application file for complete search history.

(56) References Cited

U.S. PATENT DOCUMENTS 6,185,387 B1 * 2/2001 Ohzeki et al. ..... 399/66

FOREIGN PATENT DOCUMENTS

JP 11-219044 8/1999
JP 2000-250326 9/2000

* cited by examiner

*Primary Examiner*—Judy Nguyen
*Assistant Examiner*—Allister Primo
(74) *Attorney, Agent, or Firm*—Smith, Gambrell & Russell, LLP

(57) ABSTRACT

Upon occurrence of jamming in an apparatus, an electrification unit 4 ceases electrification of a surface of a photosensitive drum 3 and, simultaneously, an exposure unit 5 starts to expose the entire surface in a width direction to light. Further, a development unit 6 forms a toner adhesion region T on the photosensitive drum 3 and, also, stops a drum motor and a belt motor in such a manner that the toner adhesion region T stops at a transfer nip section N. Thus, it is possible to alleviate a rub between the photosensitive drum 3 and a conveyance belt 8 at the time when jamming is cleared, and to suppress generation of scratches on the photosensitive drum 3 and a surface of the conveyance belt 8.

8 Claims, 5 Drawing Sheets

IMAGE FORMING APPARATUS

BACKGROUND OF THE INVENTION

This application is based on Japanese Patent Application No. 2004-345223 filed on Nov. 30, 2004.

FIELD OF THE INVENTION

The present invention relates to an image forming apparatus such as a copier, a facsimile or a printer. In particular, the present invention relates to a method for preventing a photosensitive drum and a surface of a belt from being damaged upon occurrence of jamming in an image formation section.

DESCRIPTION OF THE PRIOR ART

In an image forming apparatus using electrophotography, such as a copier, a printer or a facsimile, a powdery development agent (hereinafter, referred to as "toner") is mainly used, and the following process is generally performed. That is, a powdery development agent (hereinafter, referred to as "toner") is mainly used, and an electrostatic latent image formed on an image carrier such as a photosensitive drum is visualized by the toner. This toner image is transferred onto a recording medium and, thereafter, is fixated.

FIG. 5 is a sectional view showing an overall configuration of a conventional image forming apparatus. In an image forming apparatus 1, an image formation section P is disposed above a conveyance belt 8. The image formation section P forms a predetermined image by steps of electrification, exposure, development and transfer. Above the image formation section P, there is placed an image read section 2 for reading an original image by scanning.

The image formation section P includes a photosensitive drum 3 for carrying a visible image (toner image). The toner image formed on the photosensitive drum 3 is transferred onto a sheet (recording medium) 7 carried and conveyed by the conveyance belt 8 moving adjacent to the image formation section P and, further, is fixated on the sheet 7 at a fixation section 9. Thereafter, the sheet 7 is ejected from an apparatus main body. An image forming process for the photosensitive drum 3 is performed while the photosensitive drum 3 is rotated in a clockwise direction in FIG. 5.

Next, specific description will be given of the image forming process in the image formation section P. Around and above the photosensitive drum 3 disposed rotatably, there are provided an electrification unit 4 for electrifying the photosensitive drum 3, an exposure unit (laser scanning unit or the like) 5 for exposing the photosensitive drum 3 to image information, a development unit 6 for forming a toner image on the photosensitive drum 3, and a cleaning section 10 for removing a development agent (toner) remaining on the photosensitive drum 3.

First, the electrification unit 4 evenly electrifies a surface of the photosensitive drum 3. Then, an electrostatic image according to an image signal is formed on the photosensitive drum 3 by a laser beam from the exposure unit 5 based on original image data read by the image read section 2. The development unit 6 is filled with a predetermined amount of toner by a toner container 11. This toner is supplied onto the photosensitive drum 3 by the development unit 6 and electrostatically adheres to the photosensitive drum 3, so that a toner image is formed according to the electrostatic latent image formed by exposure from the exposure unit 5.

The sheet 7 on which the toner image is transferred is accommodated in plural feed cassettes 12*a*, 12*b* and 12*c* for accommodating sheets and a stack bypass (manual feed tray) 12*d* provided thereabove, is supplied onto the conveyance belt 8 through feed rollers 13 and a resist roller 14, and is conveyed to a position of the photosensitive drum 3. The conveyance belt 8 is formed from a dielectric resin sheet, and examples thereof include an endless belt in which both ends thereof are superposed on each other and bonded to each other, and a seamless belt having no seam.

The conveyance belt 8 extends between a conveyance roller 15 on an upstream side and a conveyance roller 16 on a downstream side. When the conveyance belt 8 starts to rotate in a counterclockwise direction, the sheet 7 is conveyed from the resist roller 14 onto the conveyance belt 8. At this time, an image writing signal is turned on; thus, an image is formed on the photosensitive drum 3 at a predetermined timing. Then, an electric field is given to a lower portion of the photosensitive drum 3 by a transfer roller 17 to which a predetermined transfer voltage is applied, so that the toner image on the photosensitive drum 3 is transferred onto the sheet 7. This sheet 7 is held on the conveyance belt 8 by an electrostatic suction force. The conveyance belt 8, the conveyance rollers 15 and 16 and the transfer roller 17 configure a transfer unit R for transferring a toner image onto the sheet 7.

The sheet 7 on which the toner image is transferred is separated from the conveyance belt 8 and, then, is conveyed toward the fixation section 9. After completion of the transfer of the toner image, in order to form a subsequent new electrostatic latent image, the cleaning section 10 removes toner remaining on the surface of the photosensitive drum 3. The sheet 7 conveyed from the conveyance belt 8 to the fixation section 9 is heated and pressurized by a fixation roller 9*a* and the toner image is fixated on the surface of the sheet 7, so that a predetermined image is formed. Thereafter, the sheet 7 having the image formed thereon is ejected to an ejection tray 19 by an ejection roller 18.

In the aforementioned image forming apparatus, the sheet 7 is sometimes jammed (hereinafter, referred to as "jamming") during the image forming process due to nonuniform rotation of the photosensitive drum 3 and conveyance belt 8 and deviation in conveyance timing of the sheet 7. In this case, the image forming process is automatically ceased and the image forming apparatus notifies a user of occurrence of jamming and a site where the jamming occurs. The user needs to remove the jammed sheet so as to restore the apparatus. For example, in the case that the sheet 7 is jammed between the photosensitive drum 3 and the conveyance belt 8, the transfer unit R is separated from the photosensitive drum 3 to form a space between the conveyance belt 8 and the photosensitive drum 3; thus, the jamming is cleared.

However, if foreign matters such as sand grains or chips (shavings) are attached onto the conveyance belt 8, at the time when the transfer unit R is separated from the transfer belt 3 so as to remove the jammed sheet 7 and, then, is returned to its original position, the photosensitive drum 3 and the conveyance belt 8 are rubbed against each other, so that fine scratches is possibly made on the surface of the photosensitive drum 3. The scratches on the surface of the photosensitive drum 3 appear as black points (color points) or fine lines in a white portion or a halftone of an image to be formed, and exert an adverse influence such as deterioration of image quality. This phenomenon is especially conspicuous in the case that the photosensitive drum 3 is made of amorphous silicon and the conveyance belt 8 is made of hard resin.

In order to solve the aforementioned problem, as disclosed in JP-A 11-219044 (1999), a conventional image forming apparatus has the following configuration. That is, a transfer roller for pressing a conveyance belt against a photosensitive drum is supported by an elastic member such as a spring, so that an impact generated when a transfer unit is retuned to its original position after jamming is cleared is alleviated. Further, JP-A 2000-250326 discloses an image forming apparatus having the following configuration. That is, a voltage having the same polarity as that of toner is applied to a conveyance belt during a period of driving of a conveyance belt other than a period of image formation, contaminated toner in the case that a sheet conveyance timing is delayed due to occurrence of jamming and a toner image is directly transferred on the conveyance belt can be removed quickly.

According to the configuration of JP-A 11-219044 (1999) in which the transfer roller is supported by the elastic member, a rub between the surface of the photosensitive drum and the conveyance belt at the time when the transfer unit is returned to its original position can be suppressed. However, since the conveyance belt is always pressed against the photosensitive drum, the rub therebetween cannot be avoided completely. In addition, according to the method of JP-A 2000-250326, contamination of the conveyance belt due to toner can be prevented; however, a rub between the surface of the photosensitive drum and the conveyance belt cannot be effectively reduced.

SUMMARY OF THE INVENTION

In view of the aforementioned problems, an object of the present invention is to provide an image forming apparatus capable of smoothly clearing jamming without damaging a photosensitive drum or a surface of a belt upon occurrence of the jamming in an image formation section.

In order to achieve the aforementioned object, the present invention provides an image forming apparatus comprising: an image formation section including a photosensitive drum, an electrification unit for evenly electrifying a surface of the photosensitive drum, an exposure unit for writing an electrostatic latent image onto the surface of the photosensitive drum, and a development unit for adhering toner to the surface of the photosensitive drum to form a toner image according to the electrostatic latent image; a transfer unit having a conveyance belt for conveying a recording medium and a transfer roller arranged so as to oppose the photosensitive drum with the conveyance belt interposed therebetween, and for transferring the toner image formed in the image formation section onto the recording medium in contact with the photosensitive drum; detection means for detecting occurrence of jamming in the apparatus; and control means for controlling operations of the image formation section and the transfer unit, wherein the transfer unit or the photosensitive drum is manually separated to thereby clear jamming. Herein, upon detection of jamming by the detection means, the control means adheres the toner to a predetermined region on the photosensitive drum and, also, ceases rotation of the photosensitive drum and driving of the conveyance belt in such a manner that the toner adhesion region stops at a contact position between the photosensitive drum and the conveyance belt.

With this configuration, when the image forming process is ceased due to occurrence of jamming, the toner layer is always present in the contact position between the photosensitive drum and the conveyance belt. In the case that the transfer unit is separated from the photosensitive drum to clear the jamming and, then, is returned to its original position, it is possible to alleviate a rub between the photosensitive drum and the conveyance belt and to suppress generation of scratches on the photosensitive drum and the surface of the conveyance belt.

According to the present invention, in the image forming apparatus having the aforementioned configuration, the toner adhesion region is formed by exposure of the predetermined region of the surface of the photosensitive drum by the exposure unit and/or cessation of electrification by the electrification unit.

With this configuration, the toner adhesion region is formed by the exposure of the predetermined region of the surface of the photosensitive drum by the exposure unit and/or the cessation of electrification by the electrification unit, so that it is possible to adhere a predetermined amount of toner to the predetermined region of the surface of the photosensitive drum in accordance with procedures similar to a case of normal toner image formation.

According to the present invention, in the image forming apparatus having the aforementioned configuration, the transfer roller is applied with a voltage having the same polarity as that of toner during a period from detection of jamming by the detection means until stoppage of the photosensitive drum.

With this configuration, the voltage having the same polarity as that of toner is applied to transfer roller during the period from detection of jamming by the detection means until stoppage of the photosensitive drum. As a result, in the case that the photosensitive drum and the conveyance belt are stopped with a sheet jammed therebetween, it is possible to prevent the toner adhering to the surface of the photosensitive drum from moving toward the conveyance belt and, even after removal of the sheet, to effectively prevent generation of scratches because of the presence of the toner layer at the contact position. In addition, since unfixated toner does not adhere onto a sheet or the conveyance belt, there is no fear that the interior of the apparatus and the hands and fingers of a user are contaminated when user clears jamming.

According to the present invention, in the image forming apparatus having the aforementioned configuration, a timing at which the driving of the conveyance belt is ceased is in synchronization with a timing at which the rotation of the photosensitive drum is ceased.

With this configuration, the timing at which the driving of the conveyance belt is ceased is made synchronous with the timing at which the rotation of the photosensitive drum is ceased, so that it is possible to eliminate the peripheral speed difference between the conveyance belt and the photosensitive drum and to effectively reduce friction at a contact position between the conveyance belt and the photosensitive drum.

DESCRIPTION OF THE PREFERRED EMBODIMENTS

Figure 1:
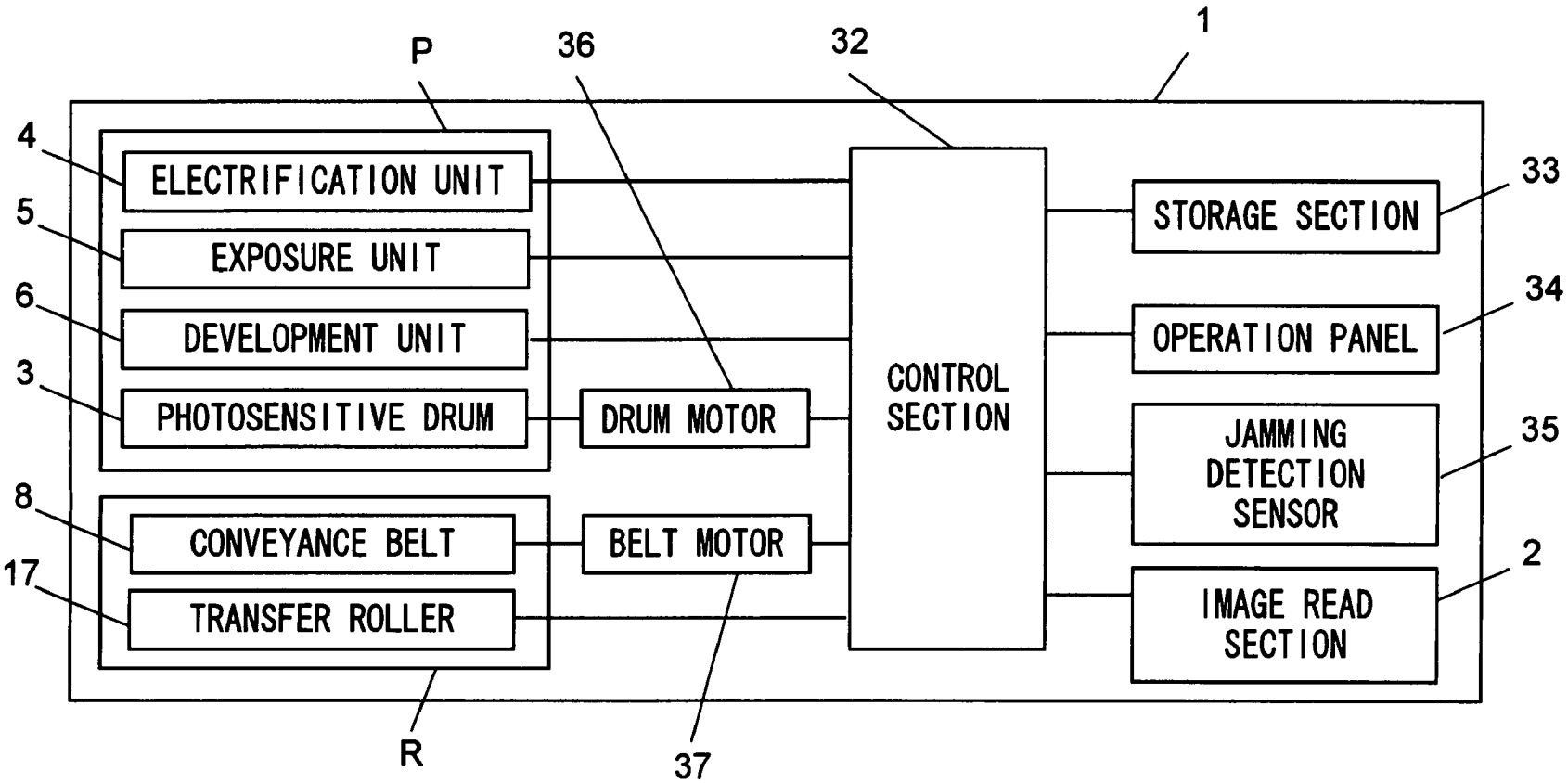
FIG. 1 is a block diagram showing a configuration of an image forming apparatus according to the present invention.
Figure 5:
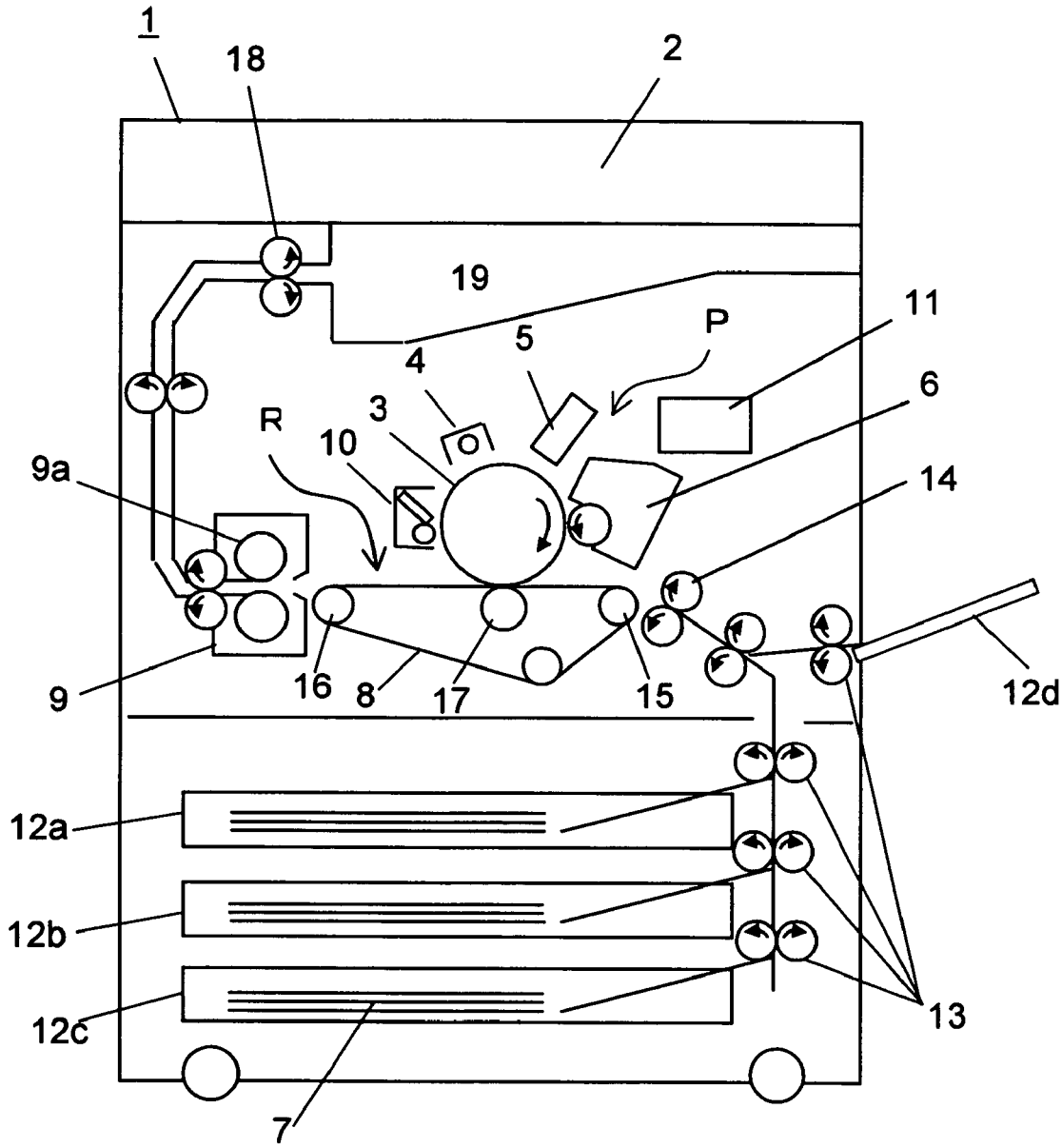
FIG. 5 is a schematic view showing an overall configuration of a conventional image forming apparatus.

Hereinafter, description will be given of embodiments of the present invention with reference to the drawings. FIG. 1 is a block diagram showing a configuration of an image forming apparatus according to the present invention. Common components with the conventional example in FIG. 5 are denoted by the same reference numerals. An image forming apparatus 1 includes an image read section 2, an image formation section P, a transfer unit R, a control section 32, a storage section 33, an operation panel 34 and a jamming detection sensor 35.

The image read section 2 includes a scanning optical system equipped with a scanner lamp for illuminating an original upon copying and a mirror for changing an optical path of light reflected from the original, a condenser lens for condensing the light reflected from the original to form an image, a CCD for converting formed image light into an electric signal, and the like. An image signal read by the image read section 2 is sent to the control section 32, is appropriately subjected to image processing such as gradation processing, and is converted into image data.

The image formation section P includes a photosensitive drum 3, an electrification unit 4, an exposure unit 5, a development unit 6 and the like, and forms an electrostatic latent image on the photosensitive drum 3 on the basis of the image data converted in the control section 32. A drum motor 36 is provided for rotationally driving the photosensitive drum 3. The control section 32 transmits a control signal to the drum motor 36 to control rotation and stoppage of the photosensitive drum 3. The control section 32 also controls the respective components in the image forming apparatus, such as the image read section 2, the electrification unit 4, the exposure unit 5 and the development unit 6, in accordance with a preset program.

The transfer unit R includes a conveyance belt 8, a transfer roller 17 and the like. When a high-voltage power supply circuit (not shown) supplies a transfer bias voltage to the transfer roller 17, the transfer unit R transfers, onto a sheet, a toner image developed on the photosensitive drum 3. A belt motor 37 is provided for rotationally driving the conveyance belt 8. The control section 32 transmits a control signal to the belt motor 37 to control rotation and stoppage of the conveyance belt 8.

The storage section 33 stores control programs for the respective components in the image forming apparatus, used by the control section 32. As will be described later, the storage section 33 also stores an execution time of a step of adhering toner onto the photosensitive drum 3 and stoppage timings of the drum motor 36 and belt motor 37 at the time when jamming is detected by the jamming detection sensor 35. The operation panel 34 includes an operation key (not shown) by which a user performs setting of the functions of the apparatus, printing conditions and the like, and a display part (not shown) for displaying setting conditions, the status of the apparatus, and the like.

The jamming detection sensors 35 are provided at plural portions on a sheet conveyance path in the image forming apparatus 1. Each jamming detection sensor 35 detects passage of a sheet to determine whether or not jamming occurs in the apparatus and, also, transmits the detection result to the control section 32. The control section 32 controls the electrification unit 4, the exposure unit 5, the development unit 6 and the transfer roller 17 on the basis of the detection result of the jamming detection sensor 35, forms a toner adhesion region at a predetermined region on the photosensitive drum 3, and stops the photosensitive drum 3 and the conveyance belt 8 at a predetermined timing.

As the jamming detection sensor 35, various sensors capable of detecting passage of a sheet can be used, and examples thereof include an arm-type sensor for detecting a sheet in such a manner that the sheet directly abuts against the sensor, a reflection-type sensor having a light emitting part for emitting light onto a sheet and a light receiving part for detecting light reflected from the sheet, and the like. The detection result of the jamming detection sensor 35 is displayed on the display part of the operation panel 34, and the user receives notification about occurrence of jamming and a site where the jamming occurs.

The present invention has a feature in that, if jamming occurs in the apparatus, a region where toner adheres to a predetermined position on the photosensitive drum 3 (hereinafter, referred to as "toner adhesion region") is formed and, also, the toner adhesion region is stopped at a contact position (transfer nip portion) between the photosensitive drum 3 and the conveyance belt 8. With this feature, when the image forming process is ceased after occurrence of jamming, a toner layer is always present in the transfer nip portion. In the case that the transfer unit R is separated from the photosensitive drum 3 to clear the jamming and the transfer unit R is again brought into contact with the photosensitive drum 3, it is possible to alleviate a rub between the photosensitive drum 3 and the conveyance belt 8 and to suppress generation of scratches on the photosensitive drum 3 and the surface of the conveyance belt 8.

The user is not always necessarily to accurately grasp the position where the jamming occurs. It is considered that even when the jamming occurs at a position other than the image formation section P, the transfer unit R is separated from the photosensitive drum 3. Therefore, it is preferred that the toner adhesion region is formed irrespective of the position where the jamming occurs and is stopped at the contact position between the photosensitive drum 3 and the conveyance belt 8.

Figure 2A:
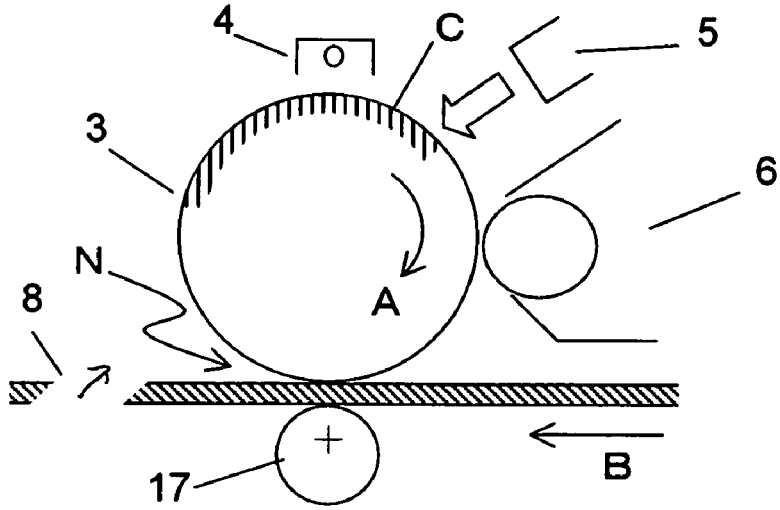
FIGS. 2A to 2C are schematic views each showing states of an image formation section and a transfer unit during a period from detection of jamming until cessation of a job.
Figure 2B:
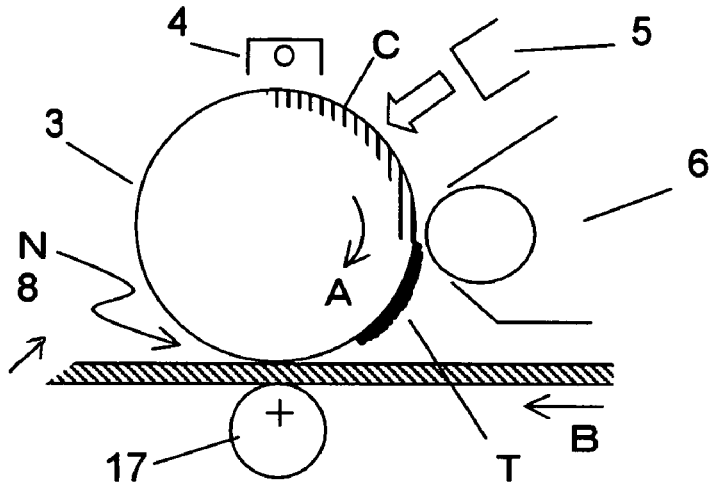
Figure 2C:
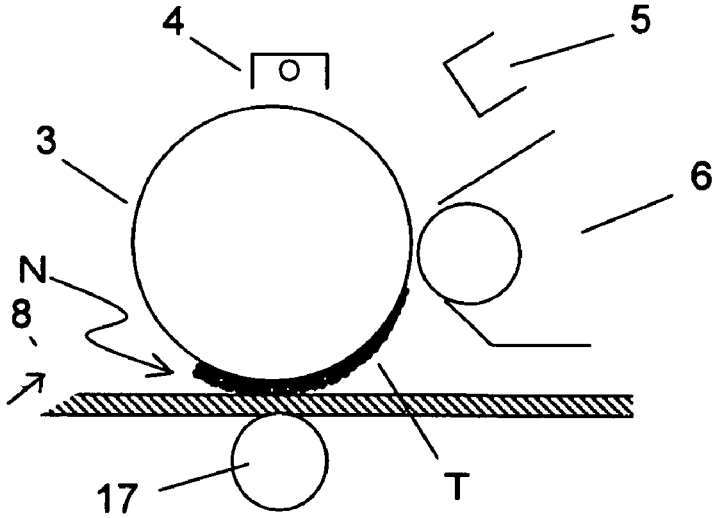

FIGS. 2A to 2C are schematic views each showing states of the image formation section and transfer unit during a period from detection of jamming until cessation of a job. For the sake of simplification of description, the cleaning section 10 and the conveyance rollers 15 and 16 will not described herein. With reference to FIG. 1 and FIGS. 2A to 2C, specific description will be given of formation of a toner adhesion region in the image forming apparatus according to the present invention.

FIG. 2A shows a state of the image formation section P immediately after detection of jamming. In FIG. 2A, the photosensitive drum 3 rotates in the direction of arrow A and the conveyance belt 8 is driven in the direction of arrow B. When the jamming detection sensor 35 detects occurrence of jamming and the control section 32 receives the detection result, the control section 32 controls the electrification unit 4 so as to cease electrification of the surface of the photosensitive drum 3 and, simultaneously, controls the exposure unit 5 so as to expose, to light, the entire surface of the photosensitive drum 3 in a width direction.

More specifically, in the surface of the photosensitive drum 3, a region (region C in FIG. 2A) passing the exposure unit 5 after detection of jamming is not electrified. From this state, the photosensitive drum 3 further rotates in the direction of arrow A and toner adheres to the region C by the development unit 6, so that a toner adhesion region is formed. In addition, the transfer roller 17 is applied with a positive bias voltage having the same polarity as that of the toner, and the toner adhering to the photosensitive drum 3 does not move onto the conveyance belt 8.

FIG. 2B shows a state that, after lapse of a predetermined time from the state of FIG. 2A, the drum motor 36 for driving the photosensitive drum 3 and the belt motor 37 for driving the conveyance belt 8 are stopped. Toner successively adheres to the region C passing the development unit 6; thus, a toner adhesion region T is formed. The photosensitive drum 3 and the conveyance belt 8 are not stopped immediately after stoppage of the corresponding motors 36 and 37, but are stopped after moving in the corresponding directions of arrows A and B by a predetermined distance due to inertia.

Therefore, in consideration of the movement distance due to inertia, it is necessary to stop the drum motor 36 and the belt motor 37 before the toner adhesion region T arrives at the transfer nip portion N. At this time, it is more preferred that the photosensitive drum 3 and the conveyance belt 8 are controlled in such a manner that the respective stoppage timings are in synchronization with each other. Thus, it is possible to eliminate the peripheral speed difference between the photosensitive drum 3 and the conveyance belt 8 in stoppage and to further reduce the friction in the transfer nip portion N.

FIG. 2C shows a state that, after further lapse of a predetermined time from the state in FIG. 2B that the drum motor 36 and the belt motor 37 are stopped, the photosensitive drum 3 and the conveyance belt 8 are stopped in such a manner that the toner adhesion region T is present in the transfer nip portion N. Simultaneously, exposure by the exposure unit 5, application of the development bias to the development unit 6, and application of the bias voltage to the transfer roller 17 are ceased. When the user manually separates the transfer unit R to clear the jamming and, then, returns the transfer unit R to its original position in this state, the toner layer alleviates the rub between the photosensitive drum 3 and the conveyance belt 8. Herein, the toner on the surface of the photosensitive drum 3 is recovered by the cleaning section 10 (see FIG. 5) at the restart of the image forming process after completion of clearing the jamming.

Herein, the following method is also considered. That is, a negative bias voltage having the polarity reverse to that of the toner is applied to the transfer roller 17, the jamming is cleared in the state that the toner adheres to the conveyance belt 8, and then the toner is recovered by belt cleaning means (not shown). However, in the case that the photosensitive drum 3 and the conveyance belt 8 are stopped in the state that jamming occurs therebetween, the toner is placed on the sheet. Therefore, the toner layer is not present at the time when the conveyance belt 8 is brought into contact with the photosensitive drum 3 after removal of the sheet; thus, there is a fear that scratches are made on the photosensitive drum 3 or the conveyance belt 8. Since the unfixated toner is placed on the sheet or the conveyance belt 8, the interior of the apparatus and the hands and fingers of the user are contaminated in the case that the user clears the jamming. In order to avoid this disadvantage, as shown in FIGS. 2A to 2C, it is preferred to apply the positive bias voltage having the same polarity as that of the toner.

Figure 3:
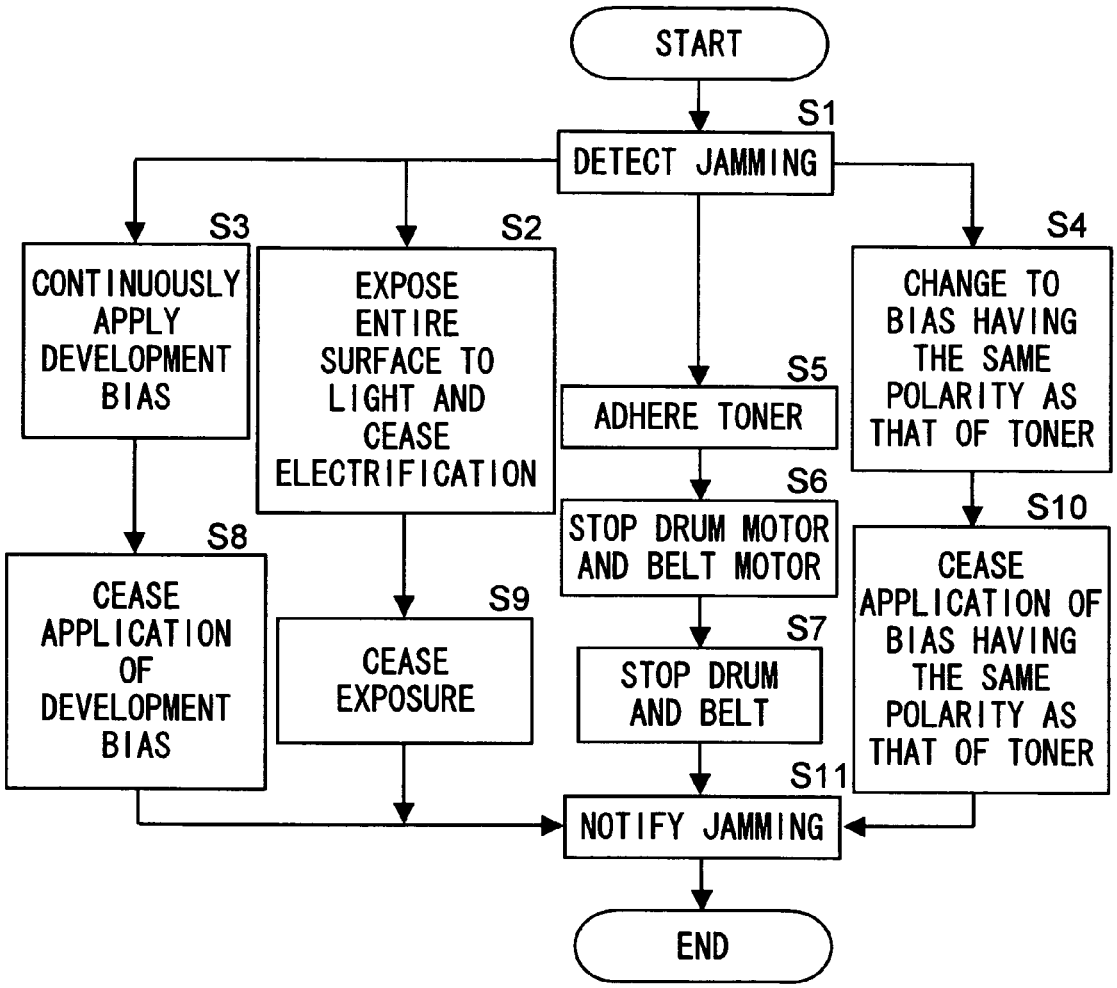
FIG. 3 is a flow chart showing operations from detection of jamming until cessation of a job, performed in the image forming apparatus according to the present invention.
Figure 4:
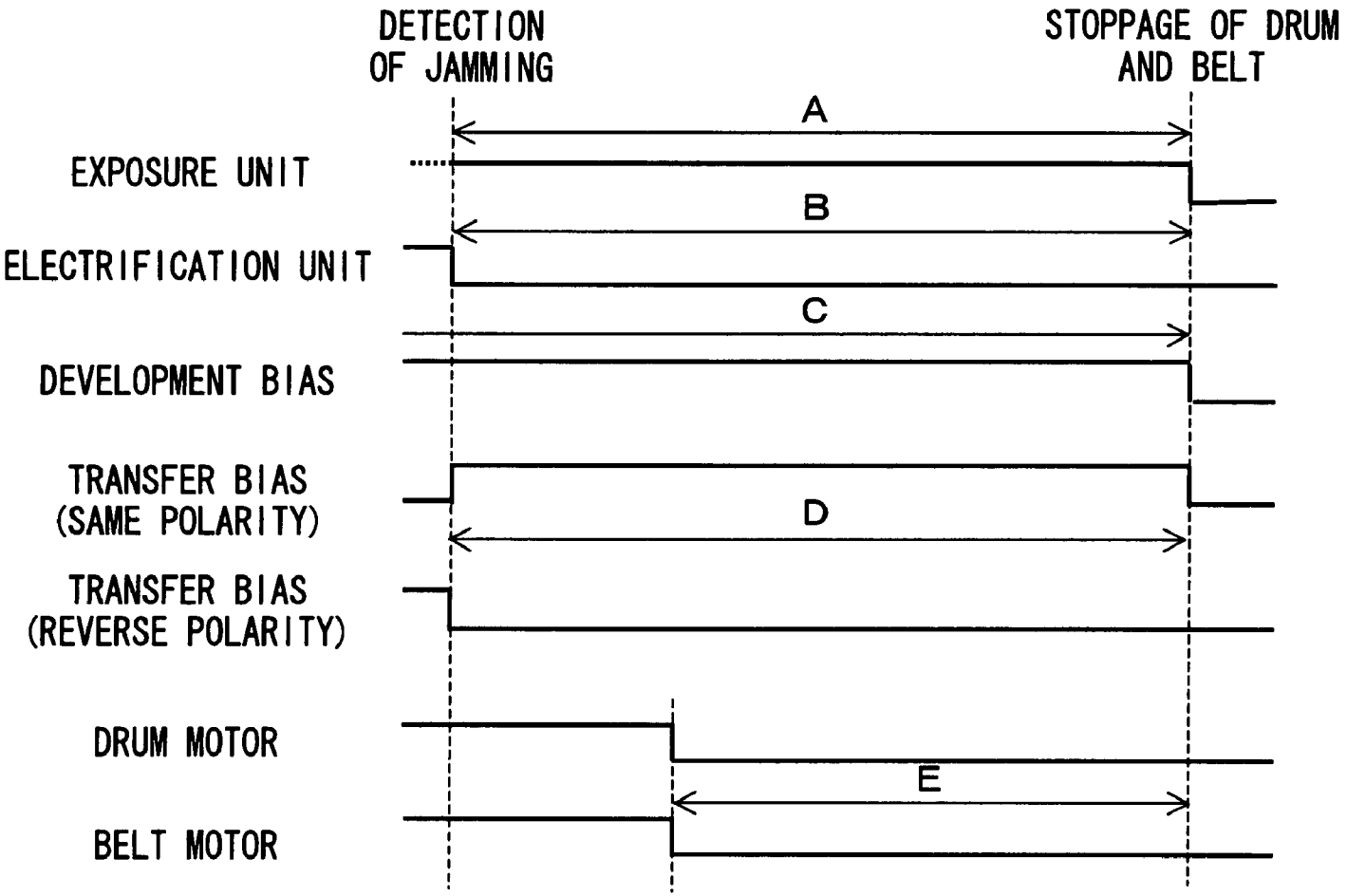
FIG. 4 is a timing chart showing operations of respective components during a period from detection of jamming until cessation of a job.

Next, description will be given of the operations of the image forming apparatus according to this embodiment. FIG. 3 is a flow chart showing operations from detection of jamming until cessation of a job, performed by the image forming apparatus according to the present invention. FIG. 4 is a timing chart showing operations of the respective components in the image forming apparatus during a period from detection of jamming until cessation of a job. With reference to FIGS. 1 and 4, description will be given of control procedures of the image forming apparatus upon detection of jamming, in accordance with steps of FIG. 3.

When the jamming detection sensor 35 detects jamming during the image forming process (step S1) and the detection result is transmitted to the control section 32, the control section 32 transmits control signals to the respective components in the image forming apparatus and changes a control from an image forming mode to a toner placing mode. More specifically, the exposure upon formation of a latent image is changed to exposure, to light, of the entire region in the sub-scanning direction upon formation of a solid image in the exposure unit 5 (arrow A in FIG. 4), application of a voltage to the electrification unit 4 is ceased (arrow B in FIG. 4), and electrification to the surface of the photosensitive drum 3 is ceased (step S2). On the other hand, application of the bias voltage to the development unit 6 (arrow C in FIG. 4) is continuously performed even after detection of jamming (step S3). In addition, simultaneously with detection of jamming, application of a bias voltage (transfer bias) having a polarity reverse to that of the toner to the transfer roller 17 is changed to application of the bias voltage having the same polarity as that of the toner (arrow D in FIG. 4) (step S4).

When a predetermined time is elapsed from the detection of jamming and the photosensitive drum 3 rotates by a predetermined distance, a region exposed by the exposure unit 5 passes the development unit 6. At this time, the toner adheres to the entire region of the surface of the photosensitive drum 3, that has passed the exposure unit 5 after detection of jamming (step S5); thus, a toner adhesion region is formed. Next, in consideration of movement distances due to inertia of the photosensitive drum 3 and the conveyance belt 8, the drum motor 36 and the belt motor 37 are stopped (arrow E in FIG. 4) at a timing that this toner adhesion region stops at a transfer nip portion (step S6).

Then, after lapse of a predetermined time, driving of the photosensitive drum 3 and that of the conveyance belt 8 are simultaneously ceased in the state that the toner adhesion region is present in the transfer nip portion (step S7). At the same time, application of the development bias to the development unit 6 and exposure by the exposure unit 5 are ceased (steps S8, S9), application of the bias voltage to the transfer roller 17 is ceased (step S10), and the toner placing mode is completed. Finally, occurrence of jamming and a site where the jamming occurs are displayed on the operation panel 34 in order to notify the user of the occurrence of jamming and the site where the jamming occurs (step S11).

By performing the control in accordance the aforementioned procedures, the apparatus is stopped in the state that the toner layer is always present in the transfer nip portion, upon occurrence of jamming. Therefore, it is possible to suppress generation of scratches on the photosensitive drum 3 and the surface of the conveyance belt 8 with reliability at the time when the transfer unit is detached to clear the jamming.

The present invention is not limited to the aforementioned embodiment, numerous modifications and variations can be devised without departing from the scope of the present invention. For example, in the aforementioned embodiment, jamming is cleared while the transfer unit R is separated from the photosensitive drum 3. However, the photosensitive drum 3 may be made movable and may be separated from the transfer unit R. Also in the aforementioned embodiment, a toner adhesion region is formed by cessation of electrification by the electrification unit 4 and exposure by the exposure unit 5. However, the toner adhesion region may be formed by either the cessation of electrification or the exposure. The present invention is applicable to various types of image forming apparatuses such as a digital copier using a conveyance belt in a transfer unit, a tandem color copier, an analog monochrome copier, a facsimile and a printer.

EXAMPLE 1

With reference to FIGS. 2A to 2C, specific description will given of controls from occurrence of jamming until cessation of a job in the image forming apparatus shown in FIG. 1. It is assumed herein that a image processing rate is 100 mm/sec, a distance from the electrification unit 4 to the exposure unit 5 on the outer peripheral face of the photosensitive drum 3 is 15 mm (150 msec), a distance from the exposure unit 5 to the development unit 6 is 5 mm (50 msec), a distance from the development unit 6 to the transfer nip portion N is 25 mm (250 msec), an inertial movement distance from stoppage of the drum motor 36 and belt motor 37 until stoppage of the photosensitive drum 3 and conveyance belt 8 is about 20 mm (about 400 msec).

First, the jamming detection sensor 35 detects jamming, simultaneously, no voltage is applied to the electrification unit 4 as shown in FIG. 2A and exposure by the exposure unit 5 is changed to entire exposure. In addition, the development bias voltage is continuously applied to the development unit 6 and the polarity of the bias voltage to be applied to the transfer roller 17 is changed from a polarity reverse to that of the toner to the same polarity as that of the toner. Thus, the toner adhesion region T is formed on the surface of the photosensitive drum 3.

Thereafter, the drum motor 36 and belt motor 37 are stopped in such a manner that the toner adhesion region T stops at the transfer nip portion N. In consideration of unevenness of the stoppage position of the photosensitive drum 3, it is assumed that the photosensitive drum 3 is stopped at a position that the tip end of the toner adhesion region T passes the transfer nip portion N by 10 mm. Since the inertial movement distance of the photosensitive drum 3 is about 20 mm, it is sufficient that the drum motor 36 and the belt motor 37 are stopped at a time point that the tip end of the toner adhesion region T arrives at a position 10 mm before the transfer nip portion N.

The tip end of the toner adhesion region T is a portion passing the exposure unit 5 to be entirely exposed to light upon detection of jamming. Since the distance from the exposure unit 5 to the transfer nip portion N is expressed by the following equation: 5+25=30 mm, the distance from the exposure unit 5 to the position 10 mm before the transfer nip portion N is expressed by the following equation: 30−10=20 mm (200 msec); thus, each of the stoppage timings of the drum motor 36 and the belt motor 37 in FIG. 2B is after 200 msec from the detection of jamming. Thereafter, the photosensitive drum 3 and the conveyance belt 8 rotate by 20 mm (about 400 msec) due to inertia and are stopped in the state shown in FIG. 2C.

That is, a time from detection of jamming until stoppage of the apparatus becomes about 600 msec, and the toner adhesion region T becomes a region (35 mm) obtained by subtracting the region (5 mm) from the exposure unit 5 to the development unit 6 from the region passing the development unit 6 during a period from detection of jamming until stoppage of the photosensitive drum 3 (movement distance until stoppage of motor: 20 mm+inertial movement distance: 20 mm=40 mm).

In the aforementioned example, the toner continuously adheres until the photosensitive drum 3 and the conveyance belt stop forming the toner adhesion region T. However, the size of the toner adhesion region T is not particularly limited as long as the toner adhesion region T stops at the transfer nip portion N with reliability. Therefore, application of the development bias to the development unit 6 may be ceased before stoppage of the photosensitive drum 3 and the conveyance belt 8. In addition, the stoppage timings of the drum motor 36 and the belt motor 37 can be set freely according to motor characteristics, the throughput of the image forming apparatus, and the like. If the inertial movement distance of the photosensitive drum 3 is different from that of the conveyance belt 8, it is sufficient that stoppage timings of the photosensitive drum 3 and the conveyance belt 8 are adjusted in such a manner that they are in synchronization with each other.

EXAMPLE 2

There was examined an effect of suppressing generation of scratches on the surface of the photosensitive drum 3 in the case that jamming is cleared through the separating/returning operation of the transfer unit R in the image forming apparatus according to the present invention. Herein, a test was conducted using an amorphous silicon drum with a diameter of 30 mm as the photosensitive drum 3 and a belt made of hard resin as the conveyance belt 8. As a test method, a large number of grains of sandpaper (grain size: about 100 μm) were dispersed around the transfer nip portion of the conveyance belt 8, an amount of toner adhering to the toner adhesion region was set to 0.5 mg/cm$^2$, the separating/returning operation of the conveyance belt 8 was repeatedly performed five times. Thereafter, as for a case that the toner adhesion region is formed (the present invention) and a case that the toner adhesion region is not formed (comparative example), respectively, the surface of the photosensitive drum and a predetermined half image were visually observed and presence/absence of scratches was evaluated.

As a result of this test, in the present invention wherein the toner adhesion region was formed on the surface of the photosensitive drum and was stopped at the transfer nip portion, no scratches were generated on the surface of the photosensitive drum. On the other hand, in the comparative example wherein the toner adhesion region was not formed on the surface of the photosensitive drum, a large number of scratches of about 200 to 500 μm were confirmed on the transfer nip portion of the surface of the photosensitive drum.

According to the present invention, upon occurrence of jamming, the image forming process is stopped in the state that the toner layer is always present in the contact position between the photosensitive drum and the conveyance belt. Thus, it is possible to provide a simple image forming apparatus capable of alleviating a rub between a photosensitive drum and a conveyance belt and suppressing generation of scratches on the photosensitive drum and the surface of the conveyance belt due to foreign matters in the case that a transfer unit or the photosensitive drum is separated to clear jamming and, then, is returned to its original position.

In addition, the exposure unit exposes the predetermined region of the surface of the photosensitive drum to light or electrification by the electrification unit is ceased to form the toner adhesion region. Therefore, it is possible to adhere toner to the predetermined region of the surface of the photosensitive drum in accordance with procedures similar to a normal image forming mode, without providing toner adhesion means separately.

Further, the voltage having the same polarity as that of toner is applied to the transfer unit during a period from detection of jamming until stoppage of the photosensitive drum. Therefore, it is possible to prevent the toner adhering to the surface of the photosensitive drum from moving toward the conveyance belt. Further, even after removing a sheet jammed between the photosensitive drum and the conveyance belt, it is possible to effectively prevent generation of scratches because of presence of the toner layer at the contact position between the photosensitive drum and the conveyance drum. In addition, unfixated toner does not adhere onto the sheet or the conveyance belt. Therefore, it is possible to prevent the interior of the apparatus and the hands and fingers of the user from being contaminated, in the case of clearing jamming.

Moreover, the stoppage timing of the conveyance belt is made synchronous with that of the photosensitive drum, so that it is possible to eliminate the peripheral speed difference between the conveyance drum and the photosensitive drum to thereby further reduce the friction in the contact position.

What is claimed is:

1. An image forming apparatus comprising:

an image formation section including a photosensitive drum, an electrification unit for evenly electrifying a surface of the photosensitive drum, an exposure unit for writing an electrostatic latent image onto the surface of the photosensitive drum, and a development unit for adhering toner to the surface of the photosensitive drum to form a toner image according to the electrostatic latent image;

a transfer unit having a conveyance belt for conveying a recording medium and a transfer roller arranged so as to oppose the photosensitive drum with the conveyance belt interposed therebetween, the transfer unit transferring the toner image formed in the image formation section onto the recording medium in contact with the photosensitive drum;

detection means for detecting occurrence of jamming in the apparatus; and control means for controlling operations of the image formation section and the transfer unit and, upon detection of jamming by the detection means, for adhering the toner to a predetermined region on the photosensitive drum and, also, ceasing rotation of the photosensitive drum and driving of the conveyance belt in such a manner that the toner adhesion region stops at a contact position between the photosensitive drum and the conveyance belt, wherein the transfer unit or the photosensitive drum is manually separated to thereby clear jamming.

2. The image forming apparatus of claim 1, wherein the toner adhesion region is formed by exposure of the predetermined region of the surface of the photosensitive drum by the exposure unit and/or cessation of electrification by the electrification unit.

3. The image forming apparatus of claim 1, wherein the transfer roller is applied with a voltage having the same polarity as that of toner during a period from detection of jamming by the detection means until stoppage of the photosensitive drum.

4. The image forming apparatus of claim 1, wherein a timing at which the driving of the conveyance belt is ceased is in synchronization with a timing at which the rotation of the photosensitive drum is ceased.

5. The image forming apparatus of claim 2, wherein the transfer roller is applied with a voltage having the same polarity as that of toner during a period from detection of jamming by the detection means until stoppage of the photosensitive drum.

6. The image forming apparatus of claim 2, wherein a timing at which the driving of the conveyance belt is ceased is in synchronization with a timing at which the rotation of the photosensitive drum is ceased.

7. The image forming apparatus of claim 3, wherein a timing at which the driving of the conveyance belt is ceased is in synchronization with a timing at which the rotation of the photosensitive drum is ceased.

8. The image forming apparatus of claim 5, wherein a timing at which the driving of the conveyance belt is ceased is in synchronization with a timing at which the rotation of the photosensitive drum is ceased.

* * * * *